US006406352B1

(12) United States Patent
Cheng

(10) Patent No.: US 6,406,352 B1
(45) Date of Patent: Jun. 18, 2002

(54) BRASSIERE CUP OF A BRA

(75) Inventor: Hsi-Chuan Cheng, Tainan (TW)

(73) Assignee: Wei Sheng Fabric Enterprise Co., Ltd., Tainan (TW)

( * ) Notice: Subject to any disclaimer, the term of this patent is extended or adjusted under 35 U.S.C. 154(b) by 0 days.

(21) Appl. No.: 09/828,812

(22) Filed: Apr. 10, 2001

(51) Int. Cl.[7] ..... A41C 3/00

(52) U.S. Cl. ..... 450/57; 450/55

(58) Field of Search ..... 450/37, 38, 57, 450/1, 55, 56; 2/267, 268; 128/112.1, 113.1; 604/385.07, 358, 367, 369, 374, 378, 385.14

(56) References Cited

U.S. PATENT DOCUMENTS

| | | | | | |
|---|---|---|---|---|---|
| 2,627,606 | A | * | 2/1953 | De Grandis | 2/267 |
| 2,891,544 | A | * | 6/1959 | London | 2/267 |
| 3,278,947 | A | * | 10/1966 | Silverman | 2/267 |
| 4,674,131 | A | * | 6/1987 | Broel | 2/267 |
| 5,458,635 | A | * | 10/1995 | Berman | 450/38 X |
| 6,213,841 | B1 | * | 4/2001 | Kuo | 450/55 |

* cited by examiner

*Primary Examiner*—Gloria M. Hale
(74) *Attorney, Agent, or Firm*—Rosenberg, Klein & Lee

(57) ABSTRACT

A brassiere cup of a bra has a main body, and exterior clothes covering two sides of the main body. The main body includes a foam rubber layer, and two silk floss layers; the silk floss layers being each coupled to a respective side of the foam rubber layer.

3 Claims, 4 Drawing Sheets

BRASSIERE CUP OF A BRA

The file of this patent contains at least one photograph executed in color. Copies of this patent with color photographs will be provided by the Patent and Trademark Office upon request and payment of the necessary fee.

BACKGROUND OF THE INVENTION

The present invention relates to a brassiere cup of a bra, and particularly to one which is well-ventilated, not easily deformed, and comfortable.

Referring to FIGS. 3–7, a conventional brassiere cup 3 of a bra includes a main body layer 31 and exterior covering cloth layers 32. The main body layer 31 is made to have a suitable shape, and is covered on its outer sides by exterior layers 32.

The main body 31 is usually made of silk floss or foam rubber material. However, foam rubber would become yellow and consequently stain the exterior cloth layers 32 yellow when repeatedly washed. And, the brassiere cup is poorly-ventilated with the foam rubber, making a wearer uncomfortable.

Silk floss material can be employed to keep the brassiere cup well-ventilated, the material tends to deform, however, after a long period of use.

SUMMARY OF THE INVENTION

Therefore, it s a main object of the present invention to provide a comfortable, well-ventilated and not-easily deformed brassiere cup for a bra.

The brassiere cup of the present invention includes a main body assembly and a pair of exterior covering cloth layers. The exterior covering cloth layers cover two sides of the main body assembly.

The main body assembly includes a foam rubber layer disposed between two silk floss lining layers. Each silk floss lining layer is coupled to an outer side of the foam rubber layer.

Because the foam rubber material is not easily deformed, and the silk floss material permits ventilation about the foam rubber material, the brassiere cup is relatively comfortable, and has relative long service life.

BRIEF DESCRIPTION OF THE DRAWINGS

The file of this patent contains at least one photograph executed in color. Copies of this patent with color phonographs will be provided by the Patent and Trademark Office upon request and payment of the necessary fee.

This invention will be better understood by referring to the accompanying drawings, wherein.

DETAILED DESCRIPTION OF THE PREFERRED EMBODIMENTS

Figure 1:
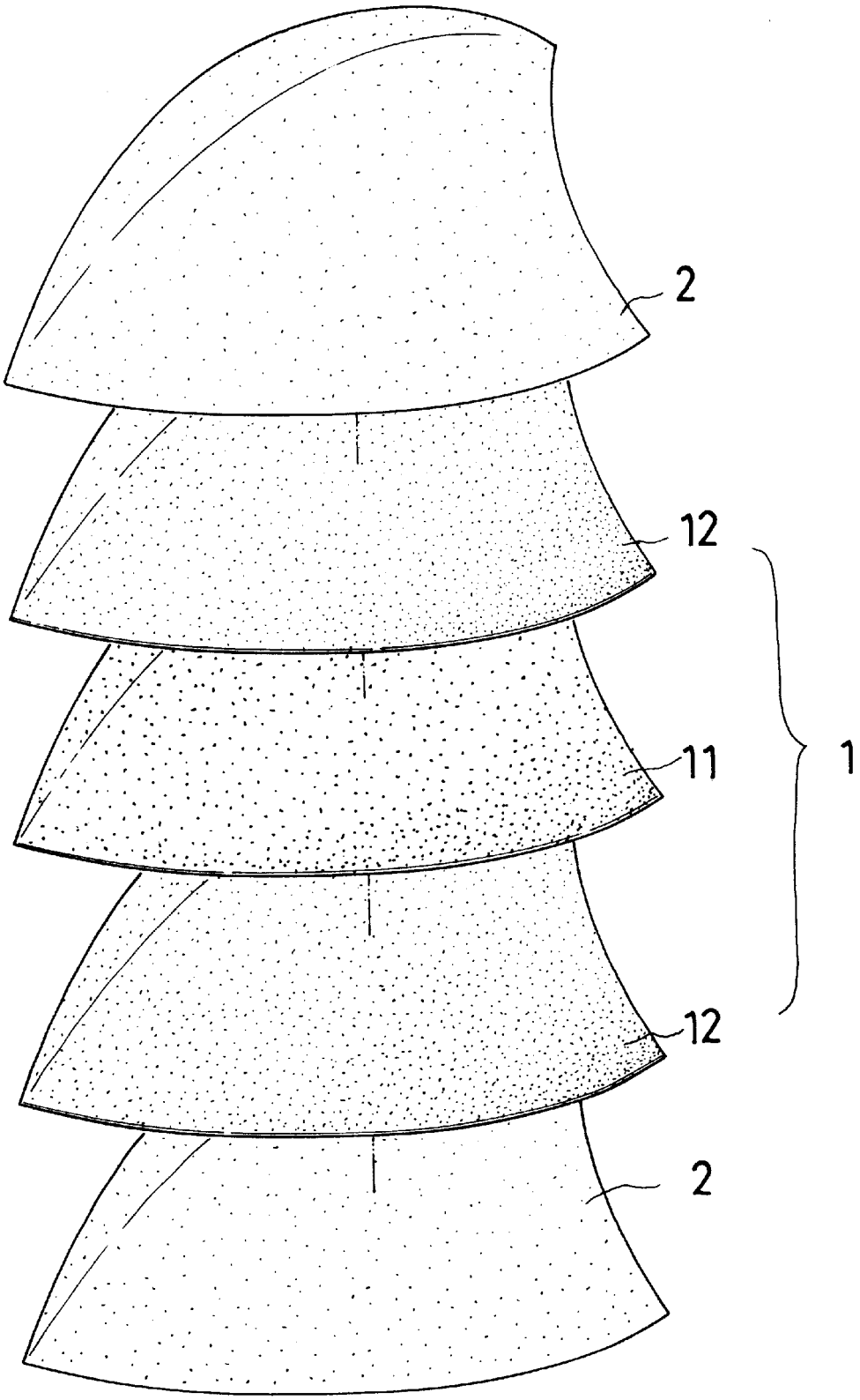
FIG. 1 is an exploded perspective view of a brassiere cup of a bra according to the present invention.
Figure 2:
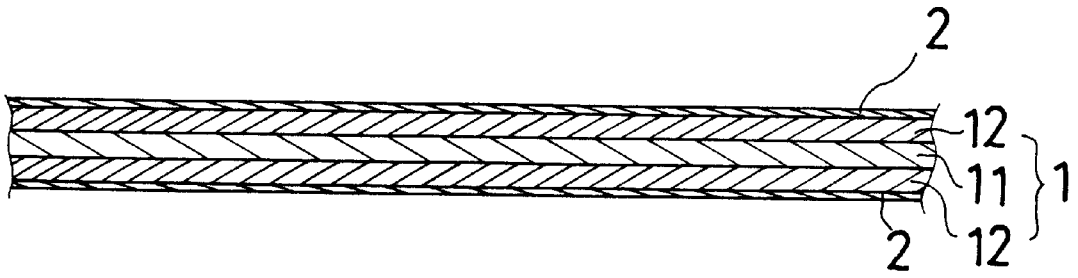
FIG. 2 is a cross-sectional view of the brassiere cup of a bra according to the present invention shown in FIG. 1.
Figure 5:
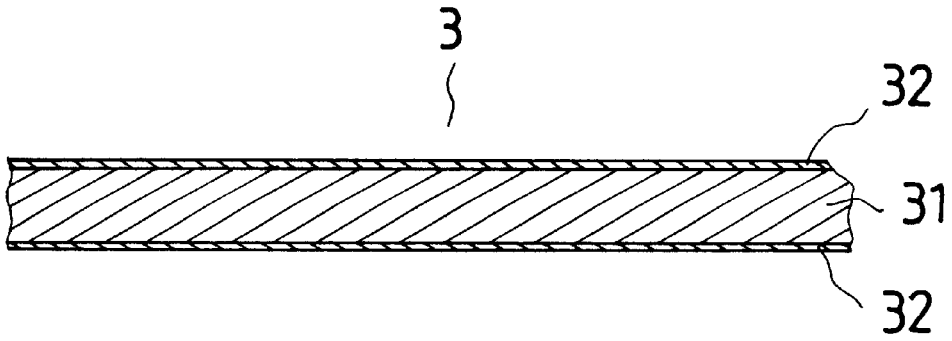
FIG. 5 (PRIOR ART)
FIG. 5 is a cross-sectional view of the conventional brassiere cup of a bra in the prior art shown in FIG. 3.
Figure 3:
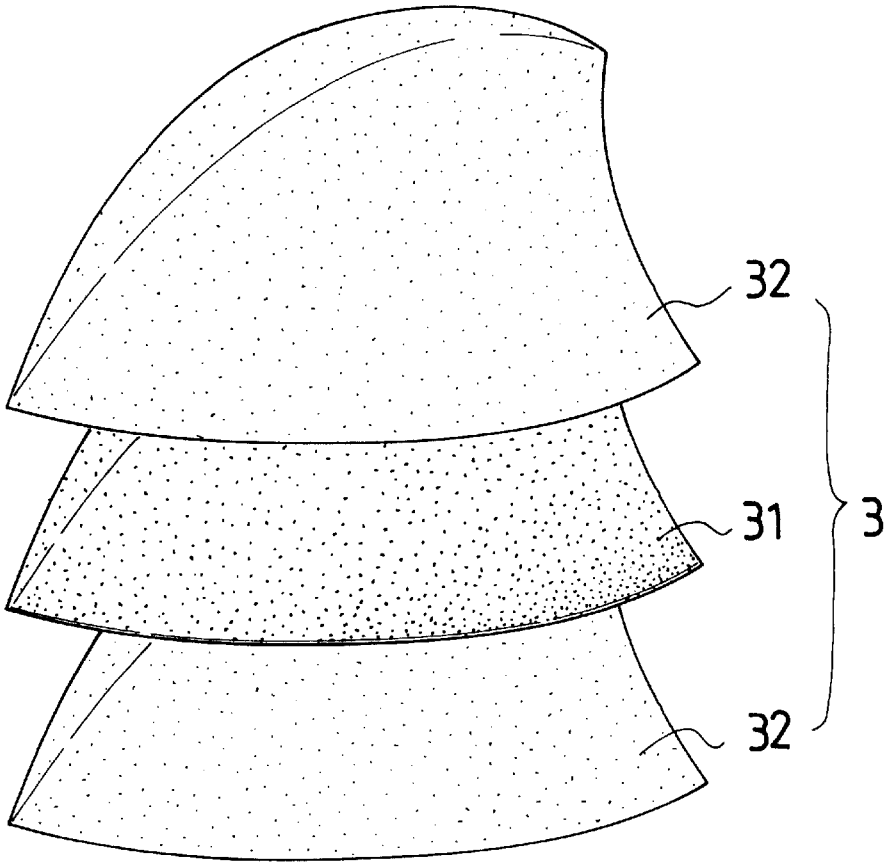
FIG. 3 (PRIOR ART)
FIG. 3 is an exploded perspective view of a conventional brassiere cup of a bra in the prior art.
Figure 4:
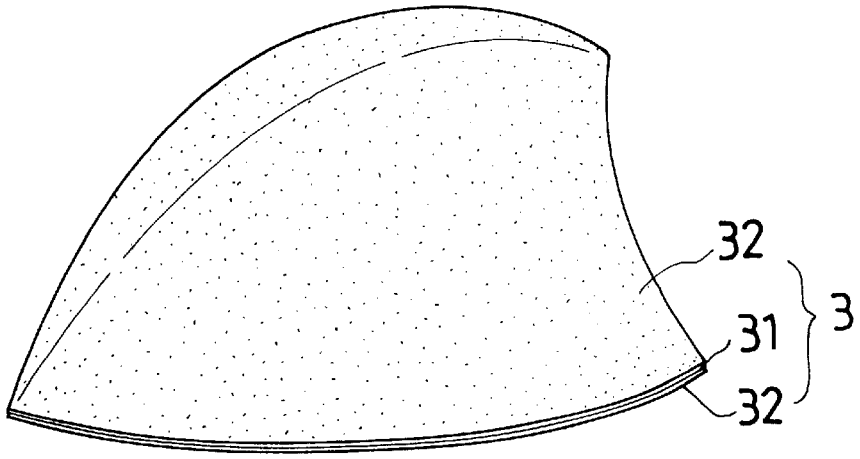
FIG. 4 (PRIOR ART)
FIG. 4 is a perspective view of the conventional brassiere cup of a bra in the prior art shown in FIG. 3.
Figure 6:
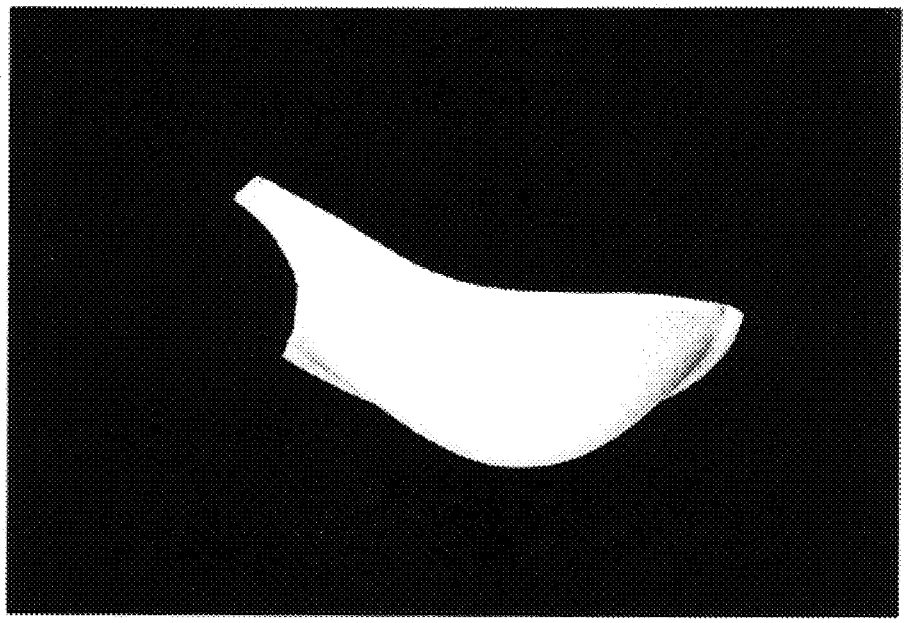
FIG. 6 (PRIOR ART)
FIG. 6 is a photograph showing the foam rubber becoming yellow in a brassiere cup of the prior art.
Figure 7:
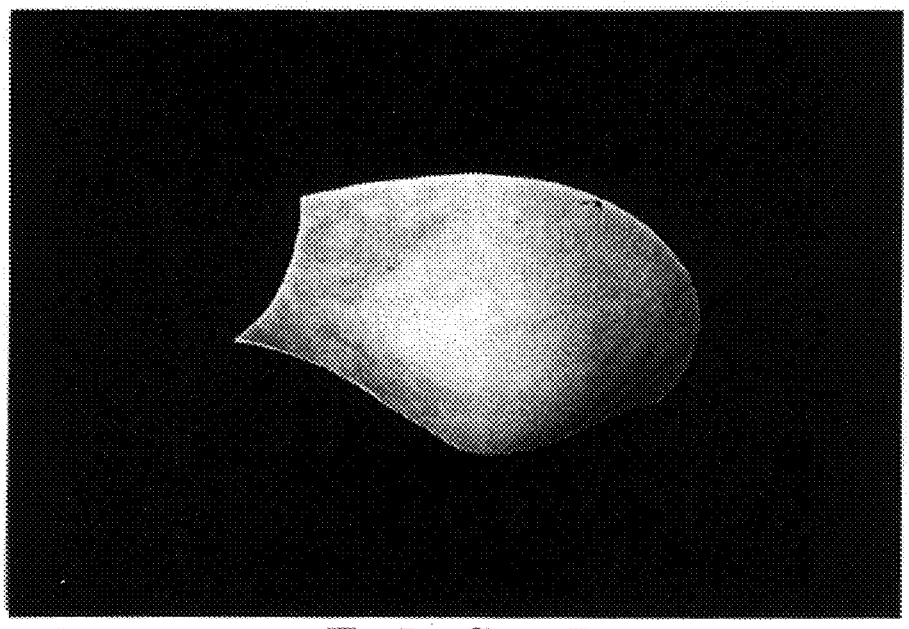
FIG. 7 (PRIOR ART)
FIG. 7 is a photograph showing the silk floss deformed in another brassiere cup of the prior art.

Referring to FIG. 1, a brassiere cup of the present invention includes a multi-layered main body assembly 1 and exterior covering cloth layers 2. The main body assembly 1 includes a layer formed of a foam rubber material 11 and two layers formed of a silk floss material 12 attached to line two sides of the foam rubber layer 11. The silk floss lining layers 12 can be attached to the foam rubber layer 11 by means of hot pressing.

The exterior covering cloth layers 2 are disposed to overlay the silk floss lining layers 12. The exterior cloth layers 2 can be made of any suitable cloth material as long as it is sufficient in structure and texture to be comfortable to the wearer.

After the brassiere cup with a suitable shape is made, it is connected to a bra. The brassiere cup can be fastened to the bra using any suitable non-sewn fastening method known in the art (to keep the bra free of potentially abrasive and irritant lines of stitching), or may simply be sewn to the bra (tolerating the lines of stitching).

From the above description, the brassiere cup of the present invention offers numerous desirable features including:

1. A property of silk floss material is the air permeability of its fibrous structure, which facilitates ventilation. Disposing layers of such silk floss material to line the exterior surfaces of the foam rubber material maintains well-ventilated layers immediately thereabout, such that ventilation of the brassiere cup can occur even when the resulting main body assembly 1 is covered by the exterior covering cloth layers 2.
2. Having the silk floss layers covering the outside of the foam rubber layer, the foam rubber layer is less likely to stain the exterior cloth layers when it becomes yellow after repeated washing.
3. The durable resilience of the foam rubber layer offers the brassiere cup a durable structural configuration. The brassiere cup's service life is, therefore, relatively long compared with a brassiere cup having only a silk floss layer for its main body.

What is claimed is:

1. A brassiere cup apparatus for a bra comprising:

(a) a multi-layered main body assembly including:
an inner layer having a predetermined contour formed of a foam rubber material, said inner layer having first and second outer sides;
at least a pair of lining layers formed of a fibrous silk floss material respectively extending in air permeable manner over said first and second outer sides of said inner layer; and, (b) at least a pair of cloth layers respectively overlaying said lining layers of said main body assembly, each said cloth layer being spaced from said inner layer by at least one said lining layer.

2. The brassiere cup apparatus as recited in claim 1 further comprising means for securely fastening at least one of said main body assembly and said cloth layers to a bra without stitching.

3. The brassiere cup apparatus as recited in claim 1 further comprising means for stitch fastening at least one of said main body assembly and said cloth layers to a bra.

* * * * *